US006704711B2

(12) United States Patent
Gustafsson et al.

(10) Patent No.: US 6,704,711 B2
(45) Date of Patent: Mar. 9, 2004

(54) SYSTEM AND METHOD FOR MODIFYING SPEECH SIGNALS

(75) Inventors: Harald Gustafsson, Lund (SE); Ulf Lindgren, Lund (SE); Clas Thurban, Vinslöv (SE); Petra Deutgen, Lund (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 382 days.

(21) Appl. No.: 09/754,993

(22) Filed: Jan. 5, 2001

(65) Prior Publication Data

US 2001/0044722 A1 Nov. 22, 2001

Related U.S. Application Data

(60) Provisional application No. 60/178,729, filed on Jan. 28, 2000.

(51) Int. Cl.[7] ..... G10L 13/00

(52) U.S. Cl. ..... 704/258; 704/201; 704/205; 704/500

(58) Field of Search ..... 704/258, 262, 704/263, 266, 500, 501, 502, 503, 504, 205, 201, 207

(56) References Cited

U.S. PATENT DOCUMENTS 5,001,758 A * 3/1991 Galand et al. ..... 704/211
6,208,959 B1 3/2001 Jonsson

FOREIGN PATENT DOCUMENTS

EP 945 852 9/1999
GB 2351889 A 1/2001

OTHER PUBLICATIONS

P.J. Patrick, et al., "Frequency Compression of 7.6 kHz Speech into 3.3 kHz bandwidth", Proceeding of ICASSP 83, IEEE International Conference on Acoustics, Speech and Signal Processing. IEEE, 3 vol. 1460, pp. p 1304–1307, vol. 3, New York USA 1983.

Heide, D., et al., Speech Enhancement for Bandlimited Speech, ICASSP 98, Proceedings of the 1998 IEEE International Conference on Acoustics, Speech and Signal Processing, IEEE, 6 vol. 1xiii+3816, pp. 393–396, vol. 1, New York USA, 1998.

Yoshida, Y. et al., "An Algorithm to Reconstruct Wideband Speech from Narrowband Speech based on Codebook Mapping", ICSLP 94, 1994 International Conference on Spoken Language Processing. Acoustical Soc. Japan, vol. 2258, pp. 1591–1594, vol. 3, Tokyo, Japan 1994.

Epps, J. et al., "Speech Enhancement Using STC–based Bandwidth Extension, ICSLP 98, Proc 5th Int. Conference on Spoken Language Processing", Sydney, Dec. 1998, vol. 2, pp. 519–522, Sydney, 1998.

Yoshida, Y et al., More Natural Sounding voice Quality over the Telephone! An Algorithm that expand the bandwidth of telephone speech, NTT Review, vol. 7, No. 3, pp. 104–109, 1995.

Yasukawa, H., "Enhancement of Telephone Speech Quality by simple Spectrum Extrapolation Method", Eurospeech 95, 4th European Conference on Speech communication and Technology, Sep., p. 1545–1548, Madrid, 1995.

Yasukawa, H., Quality Enhancement of band limited Speech by Filtering and Multi–rate Techniques, ICSLP 94, 1994 International Conference on spoken Language Processing. Acoustical Soc. Japan, 4 vol. 2258, pp. 1607–1610, vol. 3, Tokyo, Japan 1994.

(List continued on next page.)

*Primary Examiner*—Susan McFadden
(74) *Attorney, Agent, or Firm*—Burns, Doane, Swecker & Mathis, L.L.P.

(57) ABSTRACT

A system and method for speech signal enhancement upsamples a narrowband speech signal at a receiver to generate a wideband speech signal. The lower frequency range of the wideband speech signal is reproduced using the received narrowband speech signal. The received narrowband speech signal is analyzed to determine its formants and pitch information. The upper frequency range of the wideband speech signal is synthesized using information derived from the received narrowband speech signal.

17 Claims, 15 Drawing Sheets

OTHER PUBLICATIONS

Brandel, C., et al., Speech Enhancement by Speech Rate Conversion Master Thesis, MEE 99–08, University Karlskrona/Ronneby, 1999.

Tsakalos, N., et al., Threshold–based Magnitude Difference Function Pitch Determination Algorithms, International Journal of Electronics, vol. 71, No. 1, Jul., p. 13–28, 1991.

Avendano, C. et al. "Beyond Nyquist: Towards the Recovery of Broad–Bandwidth Speech from Narrow–Bandwidth Speech", Eurospeech, 1995.

Yasyhawa, H., "A Simple Method of Broadband Speech Recovery from Narrow Band Speech for Quality Enhancement", IEEE Digital Signal Processing Workshop Proceedings, 1996.

Cheng, Yan Ming et al., "Statistical Recovery of Wideband Speech from Narrowband Speech", IEEE Transactions on Speech and Audio Processing, IEEE Inc., vol. 2, No. 4, New York USA, Oct. 1994.

Yasukawa, Hiroshi, "Restoration of Wide Band Signal from Telephone Speech Using Linear Prediction Residual Error Filtering", NTT Optical Network Systems Labortories, Nippon Telegraph and Telephone Corporation, IEEE Digital Signal Processing Workshop, Loen, Norway, Sep. 1–4, 1996.

Deisher, M.E. et al., Speech Enhancement using State–based Estimation and Sinusoidal Modeling, Journal of Acoustical Society of America 102(2), Pt. 1, pp. 1141–1148, Aug. 1997.

Enborn, Niklas: Bandwidth Expansion of Speech, *Master Thesis*, 1998.

Hess, Wolfgang, "Pitch Determintion of Speech Signals", pp. 38–90, Springer–Verlag 1983.

* cited by examiner

SYSTEM AND METHOD FOR MODIFYING SPEECH SIGNALS

This application claims priority under 35 U.S.C. §§119 and/or 365 to No. 60/178,729 filed in United States of America on Jan. 28, 2000; the entire content of which is hereby incorporated by reference.

BACKGROUND

The present invention relates to techniques for transmitting voice information in communication networks, and more particularly to techniques for enhancing narrowband speech signals at a receiver.

In the transmission of voice signals, there is a trade off between network capacity (i.e., the number of calls transmitted) and the quality of the speech signal on those calls. Most telephone systems in use today encode and transmit speech signals in the narrow frequency band between about 300 Hz and 3.4 kHz with a sampling rate of 8 kHz, in accordance with the Nyquist theorem. Since human speech contains frequencies between about 50 Hz and 13 kHz, sampling human speech at an 8 kHz rate and transmitting the narrow frequency range of approximately 300 Hz to 3.4 kHz necessarily omits information in speech signal. Accordingly, telephone systems necessarily degrade the quality of voice signals.

Various methods of extending the bandwidth of speech signals transmitted in telephone systems have been developed. The methods can be divided into two categories. The first category includes systems that extend the bandwidth of the speech signal transmitted across the entire telephone system to accommodate a broader range of frequencies produced by human speech. These systems impose additional bandwidth requirements throughout the network, and therefore are costly to implement.

A second category includes systems that use mathematical algorithms to manipulate narrowband speech signals used by existing phone systems. Representative examples include speech coding algorithms that compress wideband speech signals at a transmitter, such that the wideband signal may be transmitted across an existing narrowband connection. The wideband signal must then be de-compressed at a receiver. These methods can be expensive to implement since the structure of the existing systems need to be changed.

Other techniques implement a "codebook" approach. A codebook is used to translate from the narrowband speech signal to the new wideband speech signal. Often the translation from narrowband to wideband is based on two models: one for narrowband speech analysis and one for wideband speech synthesis. The codebook is trained on speech data to "learn" the diversity of most speech sounds (phonemes). When using the codebook, narrowband speech is modeled and the codebook entry that represents a minimum distance to the narrowband model is searched. The chosen model is converted to its wideband equivalent, which is used for synthesizing the wideband speech. One drawback associated with codebooks is that they need significant training.

Another method is commonly referred to as spectral folding. Spectral folding techniques are based on the principle that content in the lower frequency band may be folded into the upper band. Normally the narrowband signal is re-sampled at a higher sampling rate to introduce aliasing in the upper frequency band. The upper band is then shaped with a low-pass filter, and the wideband signal is created.

These methods are simple and effective, but they often introduce high frequency distortion that makes the speech sound metallic.

Accordingly, there is a need in the art for additional systems and methods for transmitting narrowband speech signals. Further, there is a need in the art for systems and methods for processing narrowband speech signals at a receiver to simulate wideband speech signals.

SUMMARY

The present invention addresses these and other needs by adding synthetic information to a narrowband speech signal received at a receiver. Preferably, the speech signal is spilt into a vocal tract model and an excitation signal. One or more resonance frequencies may be added to the vocal tract model, thereby synthesizing an extra formant in the speech signal. Additionally, a new synthetic excitation signal may be added to the original excitation signal in the frequency range to be synthesized. The speech may then be synthesized to obtain a wideband speech signal. Advantageously, methods of the invention are of relatively low computational complexity, and do not introduce significant distortion into the speech signal.

In one aspect, the present invention provides a method for processing a speech signal. The method comprises the steps of: analyzing a received, narrowband signal to determine synthetic upper band content; reproducing a lower band of the speech signal using the received, narrowband signal; and combining the reproduced lower band with the determined, synthetic upper band to produce a wideband speech signal having a synthesized component.

According to further aspects of the invention, the step of analyzing further comprises the steps of: performing a spectral analysis on the received narrowband signal to determine parameters associated with a speech model and a residual error signal; determining a pitch associated with the residual error signal; identifying peaks associated with the received, narrowband signal; and copying information from the received, narrowband signal into an upper frequency band based on at least one of the determined pitch and the identified peaks to provide the synthetic upper band content.

According to further aspects of the invention, a predetermined frequency range of the wideband signal may be selectively boosted. The wideband signal may also be converted to an analog format and amplified.

In accordance with another aspect, the invention provides a system for processing a speech signal. The system comprises means for analyzing a received, narrowband signal to determine synthetic upper band content; means for reproducing a lower band of the speech signal using the received, narrowband signal; and means for combining the reproduced lower band with the determined, synthetic upper band to produce a wideband speech signal having a synthesized component.

According to further aspects of the system, the means for analyzing a received, narrowband signal to determine synthetic upper band content comprises: a parametric spectral analysis module for analyzing the formant structure of the narrowband signal and generating parameters descriptive of the narrow band voice signal and an error signal; a pitch decision module for determining the pitch of the sound segment represented by the narrowband signal; and a residual extender and copy module for processing information derived from the narrowband voice signal and generating a synthetic upper band signal component.

According to additional aspects of the invention, the residual extender and copy module comprises a Fast Fourier Transform module for converting the error signal from the parametric spectral analysis module into the frequency domain; a peak detector for identifying the harmonic frequencies of the error signal; and a copy module for copying the peaks identified by the peak detector into the upper frequency range.

In yet another aspect, the invention provides a system for processing a narrowband speech signal at a receiver. The system includes an upsampler that receives the narrowband speech signal and increases the sampling frequency to generate an output signal having an increased frequency spectrum; a parametric spectral analysis module that receives the output signal from the upsampler and analyzes the output signal to generate parameters associated with a speech model and a residual error signal; a pitch decision module that receives the residual error signal from the parametric spectral analysis module and generates a pitch signal that represents the pitch of the speech signal and an indicator signal that indicates whether the speech signal represents voiced speech or unvoiced speech; and a residual extender and copy module that receives and processes the residual error signal and the pitch signal to generate a synthetic upper band signal component.

BRIEF DESCRIPTION OF THE DRAWINGS

The objects and advantages of the invention will be understood by reading the following detailed description in conjunction with the drawings, in which.

DETAILED DESCRIPTION

The present invention provides improvements to speech signal processing that may be implemented at a receiver. According to one aspect of the invention, frequencies of the speech signal in the upper frequency region are synthesized using information in the lower frequency regions of the received speech signal. The invention makes advantageous use of the fact that speech signals have harmonic content, which can be extrapolated into the higher frequency region.

Figure 1:
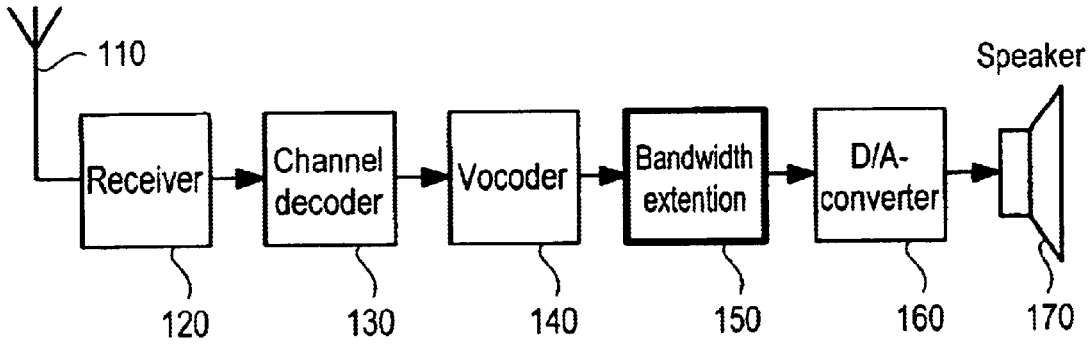
FIG. 1 is a schematic depiction illustrating the functions of a receiver in accordance with aspects of the invention.

The present invention may be used in traditional wireline (i.e., fixed) telephone systems or in wireless (i.e., mobile) telephone systems. Because most existing wireless phone systems are digital, the present invention may be readily implemented in mobile communication terminals (e.g., mobile phones or other communication devices). FIG. 1 provides a schematic depiction of the functions performed by a communication terminal acting as a receiver in accordance with aspects of the present invention. An encoded speech signal is received by the antenna 110 and receiver 120 of a mobile phone, is decoded by a channel decoder 130 and a vocoder 140. The digital signal from vocoder 140 is directed to a bandwidth extension module 150, which synthesizes missing frequencies of the speech signal (e.g., information in the upper frequency region) based on information in the received speech signal. The enhanced signal may be transmitted to a D/A converter 160, which converts the digital signal to an analog signal that may be directed to speaker 170. Since the speech signal is already digital, the sampling is already performed in the transmitting mobile phone. It will be appreciated, however, that the present invention is not limited to wireless networks; it can generally be used in all bidirectional speech communication.

Speech Production

By way of background, speech is produced by neuromuscular signals from the brain that control the vocal system. The different sounds produced by the vocal system are called phonemes, which are combined to form words and/or phrases. Every language has its own set of phonemes, and some phonemes exist in more than one language.

Speech-sounds may be classified into two main categories: voiced sounds and unvoiced sounds. Voiced sounds are produced when quasi-periodic bursts of air are released by the glottis, which is the opening between the vocal cords. These bursts of air excite the vocal tract, creating a voiced sound (i.e., a short "a" (ä) in "car"). By contrast, unvoiced sounds are created when a steady flow of air is forced through a constraint in the vocal tract. This constraint is often near the mouth, causing the air to become turbulent and generating a noise-like sound (i.e., as "sh" in "she"). Of course, there are sounds which have characteristics of both voiced sounds and unvoiced sounds.

There are a number of different features of interest to speech modeling techniques. One such feature is the formant frequencies, which depend on the shape of the vocal tract. The source of excitation to the vocal tract is also an interesting parameter.

Figure 2:
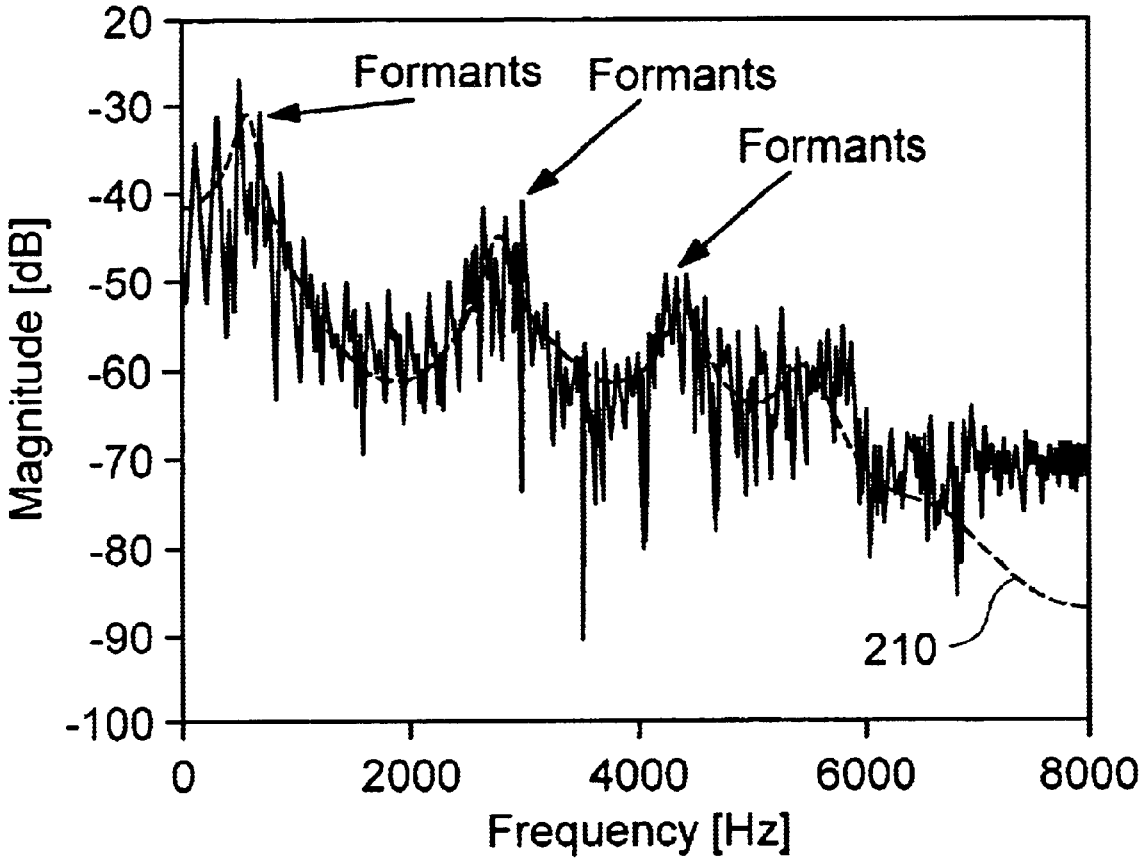
FIG. 2 illustrates a representative spectrum of voiced speech and the coarse structure of the formants.

FIG. 2 illustrates the spectrum of voiced speech sampled at a 16 kHz sampling frequency. The coarse structure is illustrated by the dashed line 210. The three first formants are shown by the arrows.

Formants are the resonance frequencies of the vocal tract. They shape the coarse structure of the speech frequency spectrum. Formants vary depending on characteristics of the speaker's vocal tract, i.e., if it is long (typical for male), or short (typical for female). When the shape of the vocal tract changes, the resonance frequencies also change in frequency, bandwidth, and amplitude. Formants change shape continuously during phonemes, but abrupt changes occur at transitions from a voiced sound to an unvoiced sound. The three formants with lowest resonance frequencies are important for sampling the produced speech sound. However, including additional formants (e.g., the 4th and 5th formants) enhances the quality of the speech signal. Due to the low sampling rate (i.e., 8 kHz) implemented in narrowband transmission systems, the higher-frequency formants are omitted from the encoded speech signal, which results in a lower quality speech signal. The formants are often denoted with $F_k$ where k is the number of the formant.

There are two types of excitation to the vocal tract: impulse excitation and noise excitation. Impulse excitation and noise excitation may occur at the same time to create a mixed excitation.

Bursts of air originating from the glottis are the foundation of impulse excitation. Glottal pulses are dependent on the sound pronounced and the tension of the vocal cords. The frequency of glottal pulses is referred to as the fundamental frequency, often denoted $F_o$. The period between two successive bursts is the pitch-period and it ranges from approximately 1.25 ms to 20 ms for speech, which corresponds to a frequency range between 50 Hz to 800 Hz. The pitch exists only when the vocal cords vibrate and a voiced sound (or mixed excitation sound) is produced.

Figure 3:
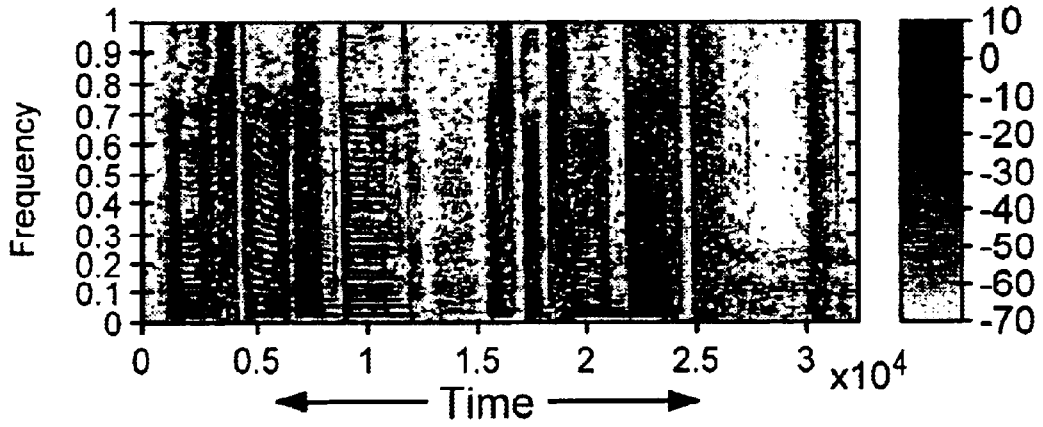
FIG. 3 illustrates a representative spectrogram.

Different sounds are produced depending on the shape of the vocal tract. The fundamental frequency $F_o$ is gender dependent, and is typically lower for male speakers than female speakers. The pitch can be observed in the frequency-domain as the fine structure of the spectrum. In a spectrogram, which plots signal energy (typically represented by a color intensity) as a function of time and frequency, the pitch can be observed as the thin horizontal lines, as depicted in FIG. 3. This structure represents the pitch frequency and it's higher order harmonics originating from the fundamental frequency.

When unvoiced sounds are produced the source of excitation represents noise. Noise is generated by a steady flow of air passing through a constriction in the vocal tract, often in the oral cavity. As the flow of air passes the constriction it becomes turbulent, and a noise sound is created. Depending on the type of phoneme produced the constriction is located at different places. The fine structure of the spectrum differs from a voiced sound by the absence of the almost equally spaced peaks.

Exemplary Speech Signal Enhancement Circuits

Figure 4:
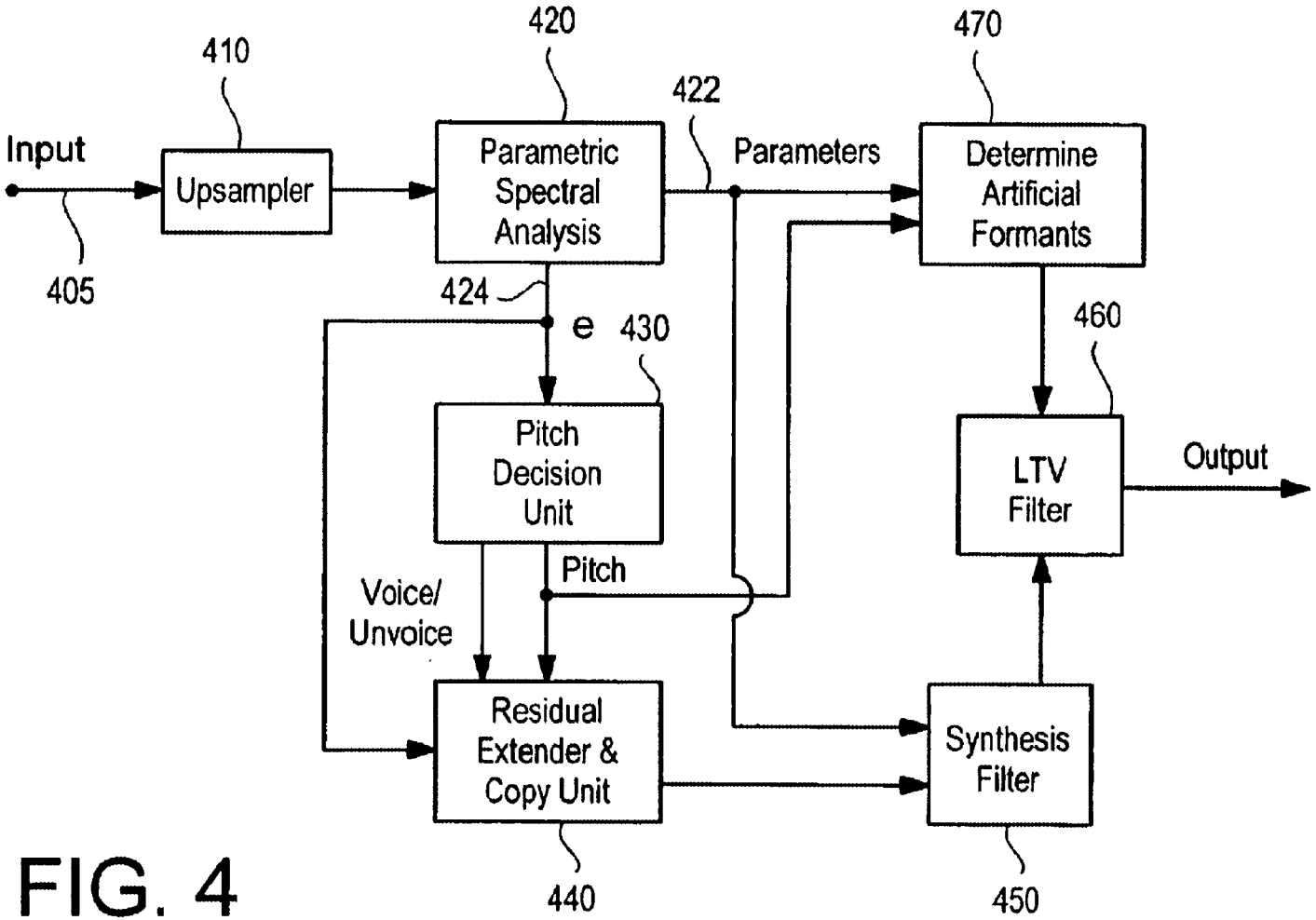
FIG. 4 is a block diagram illustrating one exemplary embodiment of a system and method for adding synthetic information to a narrowband speech signal in accordance with the present invention.

FIG. 4 illustrates an exemplary embodiment of a system and method for adding synthetic information to a narrowband speech signal in accordance with the present invention. Synthetic information can be added to a narrowband speech signal to expand the reproduced frequency band, thereby providing improved reproduced perceived speech quality. Referring to FIG. 4, an input voice or speech signal 405 received by a receiver, (e.g., a mobile phone), is first upsampled by upsampler 410 to increase the sampling frequency of the received signal. In a preferred embodiment, upsampler 410 may upsample the received signal by a factor of two (2), but it will be appreciated that other upsampling factors may be applied.

The upsampled signal is analyzed by a parametric spectral analysis module 420 to determine the formant structure of the received speech signal. The particular type of analysis performed by parametric spectral analysis unit 420 may vary. In one embodiment, an autoregressive (AR) model may be used to estimate model parameters as described below. Alternatively, a sinusoidal model may be employed in parametric spectral analysis unit 420 as described, for example, in the article entitled "Speech Enhancement Using State-based Estimation and Sinusoidal Modeling" authored by Deisher and Spanias, the disclosure of which is incorporated here by reference. In either case, the parametric spectral analysis unit 420 outputs parameters, (i.e., values associated with the particular model employed therein) descriptive of the received voice signal, as well as an error signal (e) 424, which represents the prediction error associated with the evaluation of the received voice signal by parametric spectral analysis unit 420.

The error signal (e) 424 is used by pitch decision unit 430 to estimate the pitch of the received voice signal. Pitch decision unit 430 can, for example, determine the pitch based upon a distance between transients in the error signal These transients are the result of pulses produced by the glottis when producing voiced sounds. Pitch decision module 430 also determines whether the speech content of the received signal represents a voiced sound or an unvoiced sound, and generates a signal indicative thereof. The decision made by the pitch decision unit 430 regarding the characteristic of the received signal as being a voiced sound or an unvoiced sound may be a binary decision or a soft decision indicating a relative probability of a voiced signal or an un-voiced signal.

The pitch information and a signal indicative of whether the received signal is a voiced sound or an unvoiced sound are output from the pitch decision unit 430 to a residual extender and copy unit 440. As described below with respect to FIG. 5, the residual extender and copy unit 440 extracts information from the received narrow band voice signal, (e.g., in the range of 0 to 4 kHz) and uses the extracted information to populate a higher frequency range, (e.g., 4 kHz–8 kHz). The results are then forwarded to a synthesis filter 450, which synthesizes the lower frequency range based on the parameters output from parametric spectral analysis unit 420 and the upper frequency range based on the output of the residual extender and copy unit 440. The synthesis filter 450 can, for example, be an inverse of the filter used for the AR model. Alternatively, synthesis filter 450 can be based on a sinusoidal model.

A portion of the frequency range of interest may be further boosted by providing the output of the synthesis filter 450 to a linear time variant (LTV) filter 460. In one exemplary embodiment, LTV filter 460 may be an infinite impulse response (IIR) filter. Although other types of filters may be employed, IIR filters having distinct poles are particularly suited for modeling the voice tract. The LTV filter 460 may be adapted based upon a determination regarding where the artificial formant (or formants) should be disposed within the synthesized speech signal. This determination is made by determination unit 470 based on the pitch of the received voice signal as well as the parameters output from parametric spectral analysis unit 420 based on a linear or nonlinear combination of these values, or based upon values stored in a lookup table and indexed based on the derived speech model parameters and determined pitch.

Figure 5:
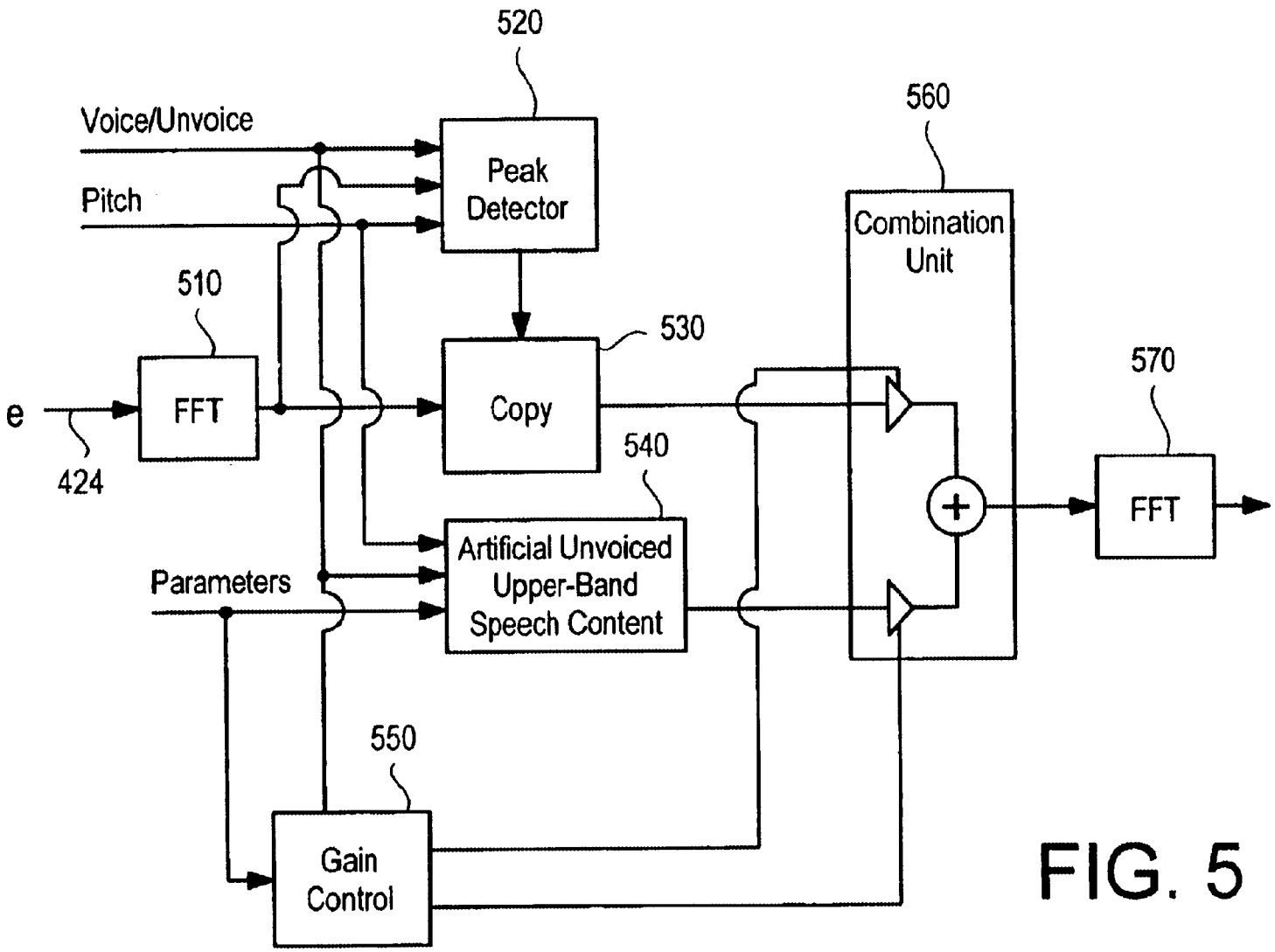
FIG. 5 is a block diagram illustrating an exemplary residual extender and copy circuit depicted in FIG. 4.

FIG. 5 depicts an exemplary embodiment of residual extender and copy unit 440. Therein, the residual error signal (e) 424 from parametric spectral analysis unit 420 is input to a Fast Fourier Transform (FFT) module 510. FFT unit 510 transforms the error signal into the frequency domain for operation by copy unit 530. Copy unit 530, under control of peak detector 520, selects information from the residual error signal (e) 424 which can be used to populate at least a portion of an excitation signal. In one embodiment, peak detector 520 may identify the peaks or harmonics in the residual error signal (e) 424 of the narrowband voice signal. The peaks may be copied into the upper frequency band by copy module 530. Alternatively, peak detector 520 can identify a subset of the number of peaks, (e.g., the first peak), found in the narrowband voice signal and use the pitch period identified by pitch decision unit 430 to calculate the location of the additional peaks to be copied by copy unit 530. The signal that indicates whether the sampled narrowband signal is a voiced sound or an unvoiced sound also is provided to peak detector 520 since peak detection and copying are replaced by artificial unvoiced upper band speech content when the speech segment represents an unvoiced sound.

Unvoiced speech content is generated by speech content unit 540. Artificial unvoiced upper band speech content can be created in a number of different ways. For example, a linear regression dependent on the speech parameters and pitch can be performed to provide artificial unvoiced upper band speech content. As an alternative, an associated memory module may include a look-up table that provides artificial upper band unvoiced speech content corresponding to input values associated with the speech parameters derived from the model and the determined pitch. The copied peak information from the residual error signal and the artificial unvoiced upper band speech content are input to combination module 560. Combination unit 560 permits the outputs of copy unit 530 and artificial unvoiced upper band speech content unit 540 to be weighted and summed together prior to being converted back into the time domain by FFT unit 570. The weight values can be adjusted by gain control unit 550. Gain control module 550 determines the flatness of the input spectrum, and uses this information and pitch information from pitch decision module 430, regulates the gains associated with the combination unit 120. Gain control unit 550 also receives the signal indicating whether the speech segment represents a voiced sound or an unvoiced sound as part of the weighting algorithm. As described above, this signal may be binary or "soft" information that provides a probability of the received signal segment being processed being either a voiced sound or an unvoiced sound.

Figure 6:
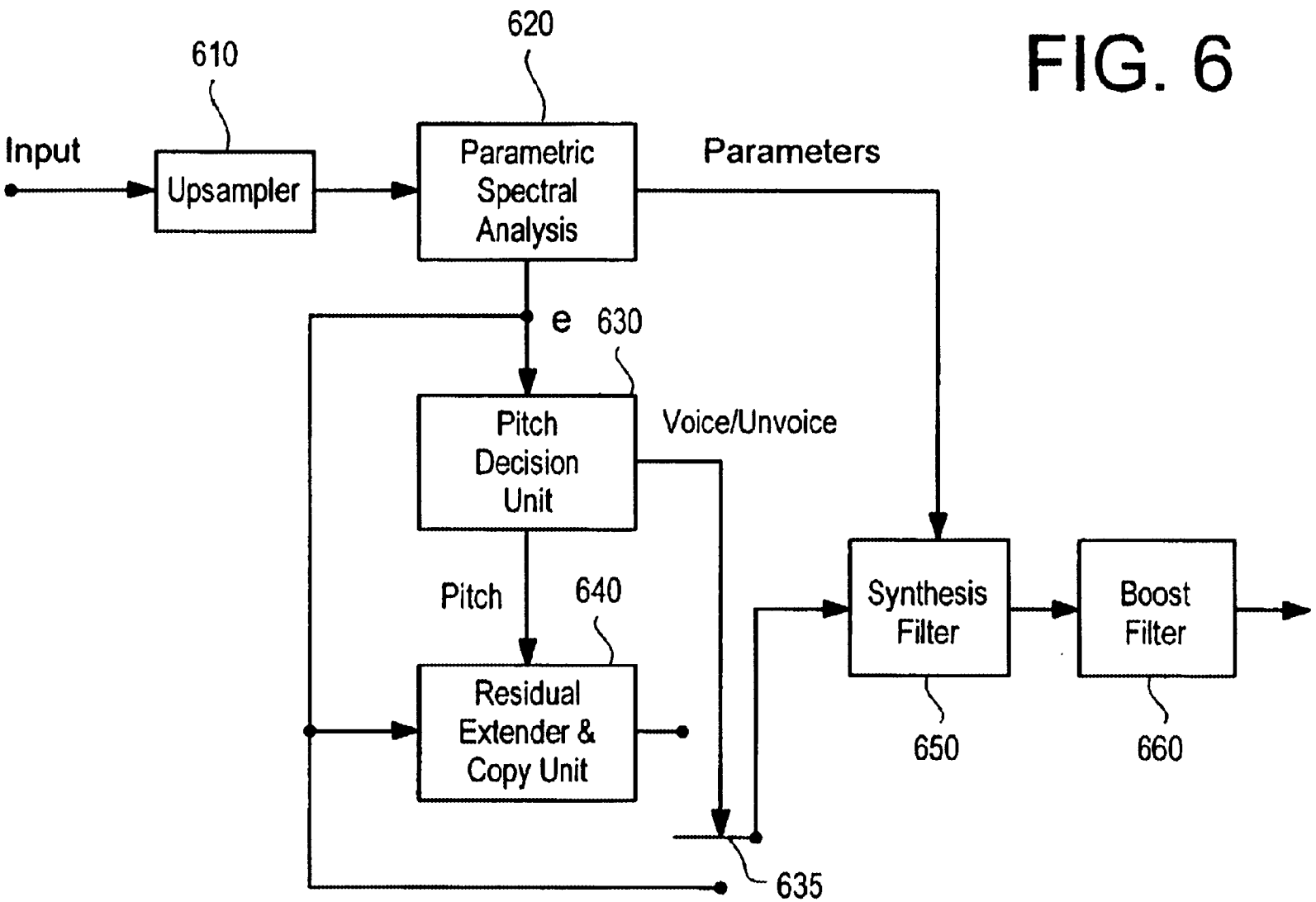
FIG. 6 is a block diagram illustrating a second exemplary embodiment of a system and method for adding synthetic information to a narrowband speech signal in accordance with the present invention.

FIG. 6 illustrates another exemplary embodiment of a system and method for adding a synthetic voice formant to an upper frequency range of a received signal. The embodiment depicted in FIG. 6 is similar to the embodiment depicted in FIG. 4, except that the residual extender and copy module 640 provides an output which is based only on information copied from the narrowband portion of the received signal. An exemplary embodiment of this residual extender and copy module 640 is illustrated as FIG. 7, and is described below. If the pitch decision unit 630 determines that a particular segment of interest represents an unvoiced sound, it controls switch 635 to select the residual error (e) signal directly for input to synthesis filter 650. By contrast, if pitch decision module 630 determines that a voice signal is present, then switch 635 is controlled to be connected to the output of residual extender and copy unit 640 such that the upper frequency content is determined thereby. A boost filter 660 operates on the output of synthesis filter 650 to increase the gain in a predetermined portion of the desired sampling frequency. For example, boost filter 660 can be designed to increase the gain the band from 2 kHz to 8 kHz. By simulating the reproduction of various synthetic voice formants as described herein, the filter pole pairs can be optimized, for example, in the vicinity of a radius of 0.85 and an angle of $0.58\pi$.

Figure 7:
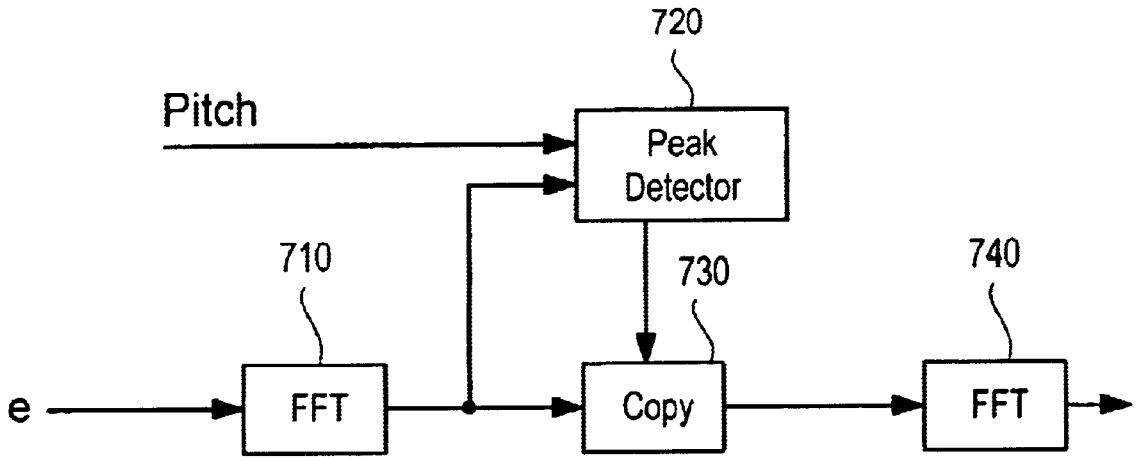
FIG. 7 is a block diagram illustrating an exemplary residual extender and copy circuit depicted in FIG. 6.

FIG. 7 provides an example of a residual extender and copy unit 640 employed in the exemplary embodiment of FIG. 6. Therein, the residual error signal (e) is once again transformed into the frequency domain by FFT unit 710. Peak detector 720 identifies peaks associated with the frequency domain version of the residual error signal (e), which are then copied by copy module 730 and transformed by into the time domain by FFT module 740. As in the exemplary embodiment of FIG. 5 peak detector 620 can detect each of the peaks independently, or a subset of the peaks, and can calculate the remaining peaks based upon the determined pitch. As will be apparent to those skilled in the art, this particular implementation of the residual extender and copy module is somewhat simplified when compared with the implementation in FIG. 5 since it does not attempt to synthesize unvoiced sounds in the upper band speech content.

Figure 8:
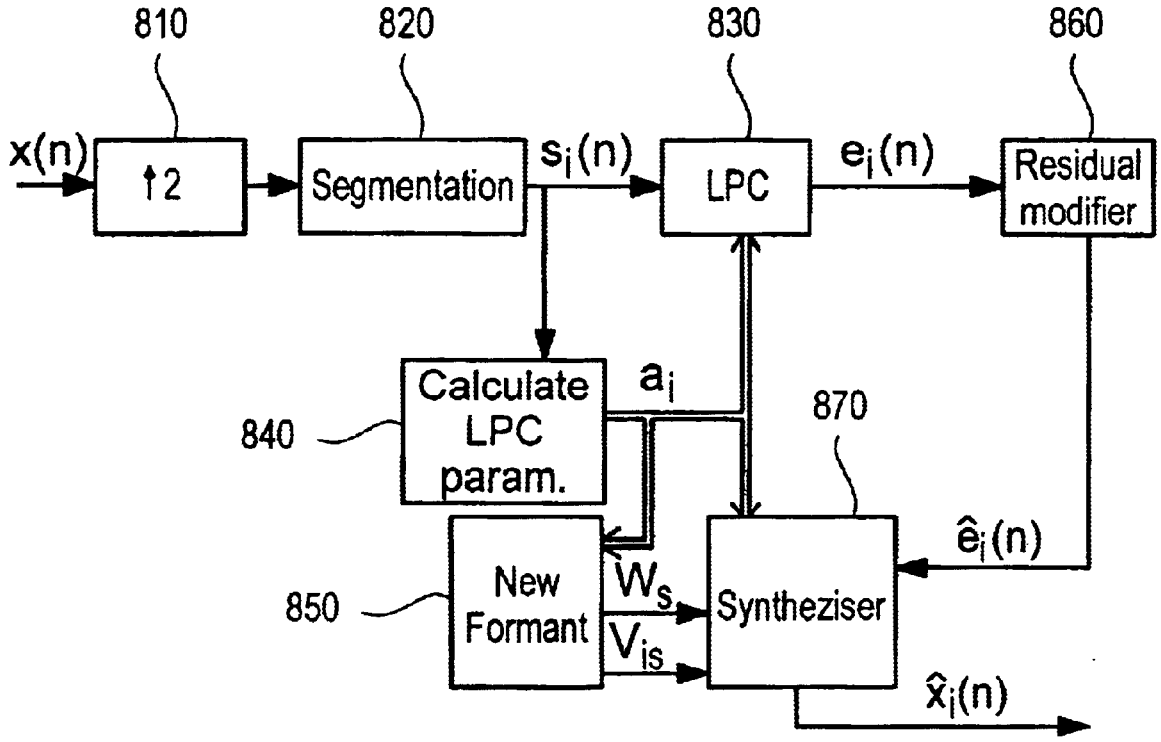
FIG. 8 is a block diagram illustrating a third exemplary embodiment of a system and method for adding synthetic information to a narrowband speech signal in accordance with the present invention.

FIG. 8 is a schematic depiction of another exemplary embodiment of a system and method for adding a synthetic voice formant to an upper frequency range of a received signal in accordance with the present invention. A narrowband speech signal, denoted by x(n) is directed to an upsampler 810 to obtain a new signal s(n) having an increased sampling frequency of, e.g., 16 kHz. It will be noted that n is the sample number. The upsampled signal s(n) is directed to a Segmentation module 820 that collects the set of samples comprising the signal s(n) into a vector (or buffer).

The formant structure can be estimated using, for example, an AR model. The model parameters, $a_k$, can be estimated using, for example, a linear prediction algorithm. A linear prediction module 840 receives the upsampled signal s(n) and the sample vector produced by Segmentation module 820 as inputs, and calculates the predictor polynomial $a_k$, as described in detail below. A Linear Predictive Coding (LPC) module 830 employs the inverse polynomial to predict the signal s(n) resulting in a residual signal e(n), the prediction error. The original signal is recreated by exciting the AR model with the residual signal e(n).

The signal is also extended into the upper part of the frequency band. To excite the extended signal, the residual signal e(n) is extended by the residual modifier module 860, and is directed to a synthesizer module 870. In addition, a new formant module 850 estimates the positions of the formants in the higher frequency range, and forwards this information to the synthesizer module 870. The synthesizer module 870 uses the LPC parameters, the extended residual signal, and the extended model information supplied by new formant module 850 to create the wide band speech signal, which is output from the system.

Figure 9:
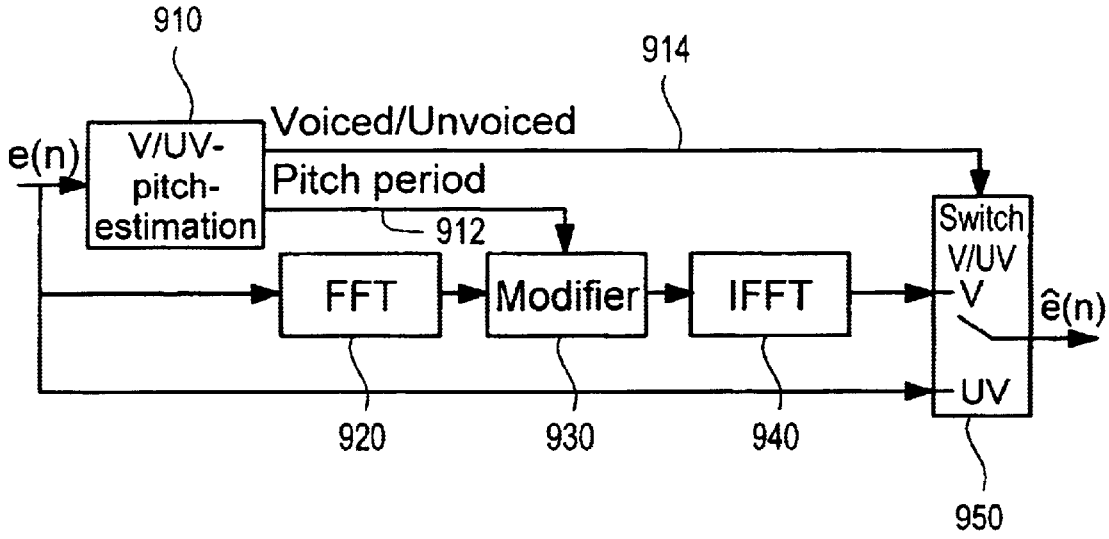
FIG. 9 is a block diagram illustrating an exemplary residual modifier in accordance with the present invention.

FIG. 9 illustrates a system for extending the residual signal into the upper frequency region, which may correspond to residual modifier module 860 depicted in FIG. 8. The residual signal $e_l(n)$ is directed to a pitch estimation module 910, which determines the pitch based upon, e.g., a distance between the transients in the error signal and generates a signal 912 representative thereof. Pitch estimation module 910 also determines whether the speech content of the received signal is a voiced sound or an unvoiced sound, and generates a signal 914 indicative thereof. The decision made by the pitch estimation module 910 regarding the characteristic of the received signal as being a voiced sound or an unvoiced sound may be a binary decision or a soft decision indicating a relative probability that the signal represents a voiced sound, or an unvoiced sound. Residual signal $e_i(n)$ is also directed to a first FFT module 920 to be transformed into the frequency domain, and to a switch 950. The output of first FFT module 920 is directed to a modifier module 930 that modifies the signal to a wideband format. The output of modifier module 930 is directed to an inverse FFT (IFFT) module 940, the output of which is directed to switch 950.

If the pitch estimation module 910 determines that a particular segment of interest represents an unvoiced sound, then it controls switch 950 to select the residual error (e) signal directly for input to synthesizer 870. By contrast, if pitch estimation module 910 determines that the segment represents a voiced sound, then switch 950 is controlled to be connected to the output of modifier module 930 and IFFT module 940, such that the upper frequency content is determined thereby. The output from switch 950 may be directed, e.g., to synthesizer 870 for further processing.

The systems described in FIG. 8 and FIG. 9 may be used to implement two methods of populating the upper frequency band. In a first method, modifier 930 creates harmonic peaks in the upper frequency band by copying parts of the lower band residual signal to the higher band. The harmonic peaks may be aligned by finding the first harmonic peak in the spectrum that reaches above the mean of the spectrum and last peak within the frequency bins corresponding to the telephone frequency band. The section between the first and last peak may be copied to the position of the last peak. This results in equally spaced peaks in the upper frequency-band. Although this method may not make the peaks reach to the end of the spectrum (8 kHz), the technique can be repeated until the end of the spectrum has been reached.

Figure 13:
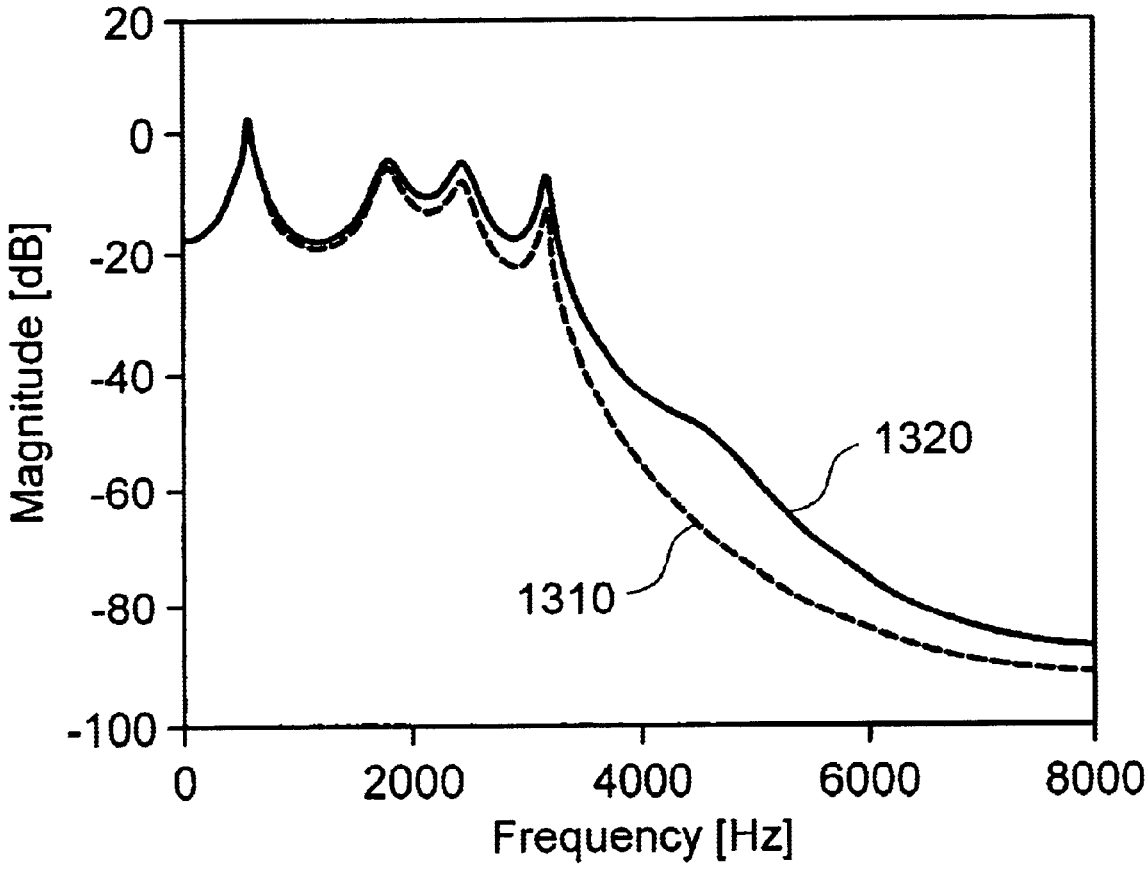
FIG. 13 is a graph illustrating the coarse structure of a speech signal before and after adding a synthetic formant to the speech signal.

The result of this process is depicted in FIG. 13, which reflects substantially equally spaced peaks in the upper frequency band. Since there is only one synthetic formant added in the vicinity of 4.6 kHz, there is no formant model that can be excited by harmonics over approximately 6 kHz. This method does not create any artifacts in the final synthetic speech. Depending on the amount of noise added in the calculation of the AR model, the extended part of the spectrum may need to be weighted with a function that decays with increasing frequency.

In the second method, modifier module 930 uses the pitch period to place the new harmonic peaks in the correct position in the. By using the estimated pitch-period it is possible to calculate the position of the harmonics in the upper frequency band, since the harmonics are assumed to be multiples of the fundamental frequency. This method makes it possible to create the peaks corresponding to the higher order harmonics in the upper frequency band.

In the Global System for Mobile communications (GSM) telephone system, the transmissions between the mobile phone and the base station are done in blocks of samples. In GSM the blocks consists of 160 samples corresponding to 20 ms of speech. The block size in GSM assumes that speech is a quasi-stationary signal. The present invention may be adapted to fit the GSM sample structure, and therefore use the same block size. One block of samples is called a frame. After upsampling, the frame length will be 320 samples and is denoted with L.

The AR Model of Speech Production

One way of modeling speech signals is to assume that the signals have been created from a source of white noise that has passed through a filter. If the filter consists of only poles, the process is called an autoregressive process. This process can be described by the following difference equation when assuming short time stationarity.

$$s_i(n) = \sum_{k=1}^{p} a_{ik} s_i(n-k) + w_i(n) \tag{1}$$

where $w_i(n)$ is white noise with unit variance, $s_i(n)$ is the output of the process and p is the model order. The $s_i(n-k)$ is the old output values of the process and $a_{ik}$ is the corresponding filter coefficient. The subscript i is used to indicate that the algorithm is based on processing time-varying blocks of data where i is the number of the block. The model assumes that the signal is stationary during in the current block, i. The corresponding system-function in the z-domain may be represented as:

$$H_i(z) = \frac{1}{1 - \sum_{k=1}^{p} a_{ik} z^{-k}} = \frac{1}{A_i(Z)} \tag{2}$$

where $H_i(z)$ is the transfer function of the system and $A_i(z)$ is called the predictor. The system consists of only poles and does not fully model the speech, but it has been shown that when approximating the vocal apparatus as a loss-less concatenation of tubes the transfer function will match the AR model. The inverse of the system function for the AR model, an all-zeros function is $$\frac{1}{H_i(z)} = 1 + \sum_{k=1}^{p} a_{ik} z^{-k} = A_i(Z) \tag{3}$$

which is called the prediction filter. This is the one-step prediction of $s_i(n+1)$ from the last p+1 values of $[s_i(n), \ldots, S_i(n-p+1)]$. The predicted signal called $\hat{s}$, (n) subtracted from the signal $s_i(n)$ yields the prediction error $e_i(n)$, which is sometimes called the residual. Even though this approximation is incomplete, it provides valuable information about the speech signal. The nasal cavity and the nostrils have been omitted in the model. If the order of the AR model is chosen sufficiently high, then the AR model will provide a useful approximation of the speech signal. Narrowband speech signals may be modeled with an order of eight (8).

The AR model can be used to model the speech signal on a short term basis, i.e., typical segments of 10–30 ms of duration, where the speech signal is assumed to be stationary. The AR model estimates an all-pole filter that has an impulse response, $\hat{s}_i(n)$, that approximates the speech signal, $s_i(n)$. The impulse response, $\hat{s}_i(n)$, is the inverse z-transform of the system function H(z). The error, e(n), between the model and the speech signal can then be defined as $$e_i(n) = s_i(n) - \hat{s}_i(n) - s_i(n) - \sum_{k=1}^{p} a_{ik}(i) s_i(n-k) \tag{4}$$

There are several methods for finding the coefficients, $a_{ik}$, of the AR model. The autocorrelation method yields the coefficients that minimize $$\varepsilon(i) = \sum_{n=0}^{L+p-1} |e_i(n)|^2 \tag{5}$$

where L is the length of the data. The summation starts at zero and ends at L+p−1. This assumes that the data is zero outside the L available data and is accomplished by multiplying $s_i(n)$ with a rectangular window. Minimizing the error function results in solving a set of linear equations $$\begin{bmatrix} r_{\bar{s}i}(0) & r_{\bar{s}i}(1) & \cdots & r_{\bar{s}i}(p-1) \\ r_{\bar{s}i}(1) & r_{\bar{s}i}(0) & \cdots & r_{\bar{s}i}(p-2) \\ \vdots & \vdots & \ddots & \\ r_{\bar{s}i}(p-1) & r_{\bar{s}i}(p-2) & \cdots & r_{\bar{s}i}(0) \end{bmatrix} \begin{bmatrix} a_{i1} \\ a_{i2} \\ \vdots \\ a_{ip} \end{bmatrix} = \begin{bmatrix} r_{\bar{s}i}(1) \\ r_{\bar{s}i}(2) \\ \vdots \\ r_{\bar{s}i}(p) \end{bmatrix} \tag{6}$$

where $r_{si}(k)$ represents the autocorrelation of the windowed data (n) and $a_{ik}$ is the coefficients of the AR model.

Equation 6 can be solved in several different ways, one method is the Levinson-Durbin recursion, which is based upon the fact that the coefficient matrix is Toeplitz. A matrix is Toeplitz if the elements in each diagonal have the same value. This method is fast and yields both the filter coefficients, $a_{ik}$, and the reflection coefficients. The reflection coefficients are used when the AR model is realized with a lattice structure. When implementing a filter in the fixed-point environment, which often is the case in mobile phones, insensitivity to quantization of the filter-coefficients should be considered. The lattice structure is insensitive to these effects and is therefore more suitable than the direct form implementation. A more efficient method for finding the reflection-coefficients is Schur's recursion, which yields only the reflection-coefficients.

Pitch Determination

Figure 10:
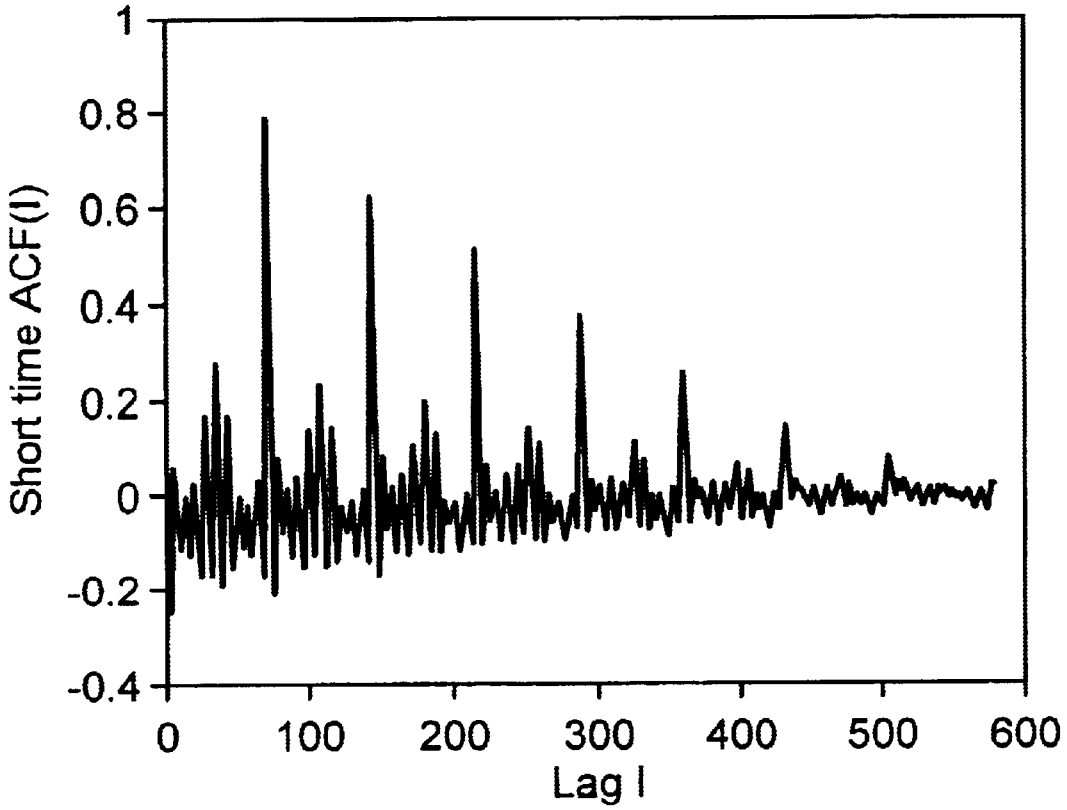
FIG. 10 is a graph illustrating a short-time autocorrelation function of a speech sample that represents a voiced sound.

Before the pitch-period can be estimated the nature of the speech segment must be determined. The predictor described below results in a residual signal. Analyzing the residual speech signal can reveal whether the speech segment represents a voiced sound or an unvoiced sound. If the speech segment represents an unvoiced sound, then the residual signal should resemble noise. By contrast, if the residual signal consists of a train of impulses, then it is likely to represent a voiced sound. This classification can be done in many ways, and since the pitch-period also needs to be determined, a method that can estimate both at the same time is preferable. One such method is based on the short-time normalized auto-correlation function of the residual signal defined as $$R_{ie}(l) = \frac{1}{R_{ie}(0)} \sum_{n=0}^{L-l-1} e_i(n)e_i(n+l) \tag{7}$$

where n is the sample number in the frame with index i, and l is the lag. The speech signal is classified as voiced sound when the maximum value of $R_{ie}(l)$ is within the pitch range and above a threshold. The pitch range for speech is 50–800 Hz, which corresponds to l in the range of 20–320 samples. FIG. 10 shows a short-time auto-correlation function of a voiced frame. A peak is clearly visible around lag 72. Peaks are also visible at multiples of the fundamental frequency.

Another algorithm suitable for analyzing the residual signal is the average magnitude difference function (AMDF). This method has a relatively low computational complexity. This method also uses the residual signal. The definition of the AMDF is $$AMDF_i(l) = \frac{1}{L}\sum_{n=0}^{L-1} |e_i(n) - e_i(n-l)| \tag{8}$$

Figure 11:
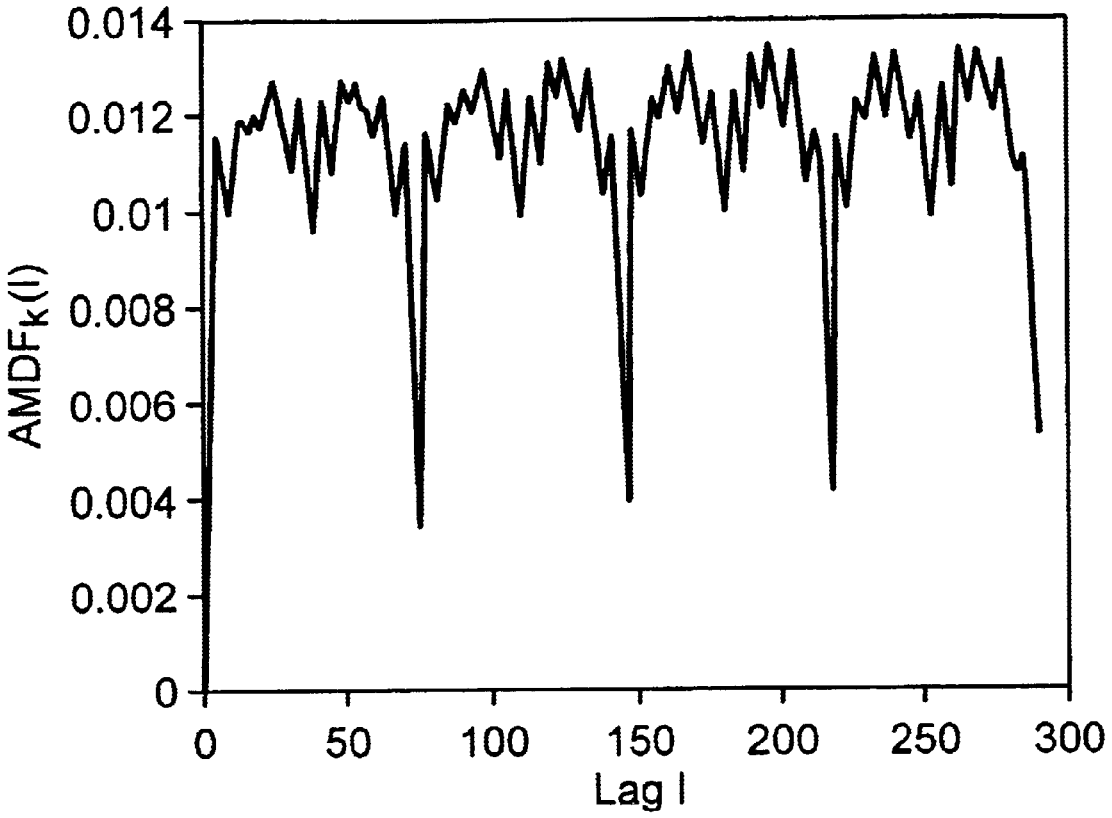
FIG. 11 is a graph illustrating an average magnitude difference function of a speech sample that represents a voiced sound.

This function has a local minimum at the lag corresponding to the pitch-period. The frame is classified as voiced sound when the value of the local minimum is below a variable threshold. This method needs at least a data-length of two pitch-periods to estimate the pitch-period. FIG. 11 shows a plot of the AMDF function for a voiced frame, several local minima can be seen. The pitch period is about 72 samples which means that the fundamental frequency is 222 Hz when the sampling frequency is 16 kHz.

Adding a Synthetic Formant

Different methods to add synthetic resonance frequencies have been evaluated. All these methods model the synthetic formant with a filter.

Figure 12:
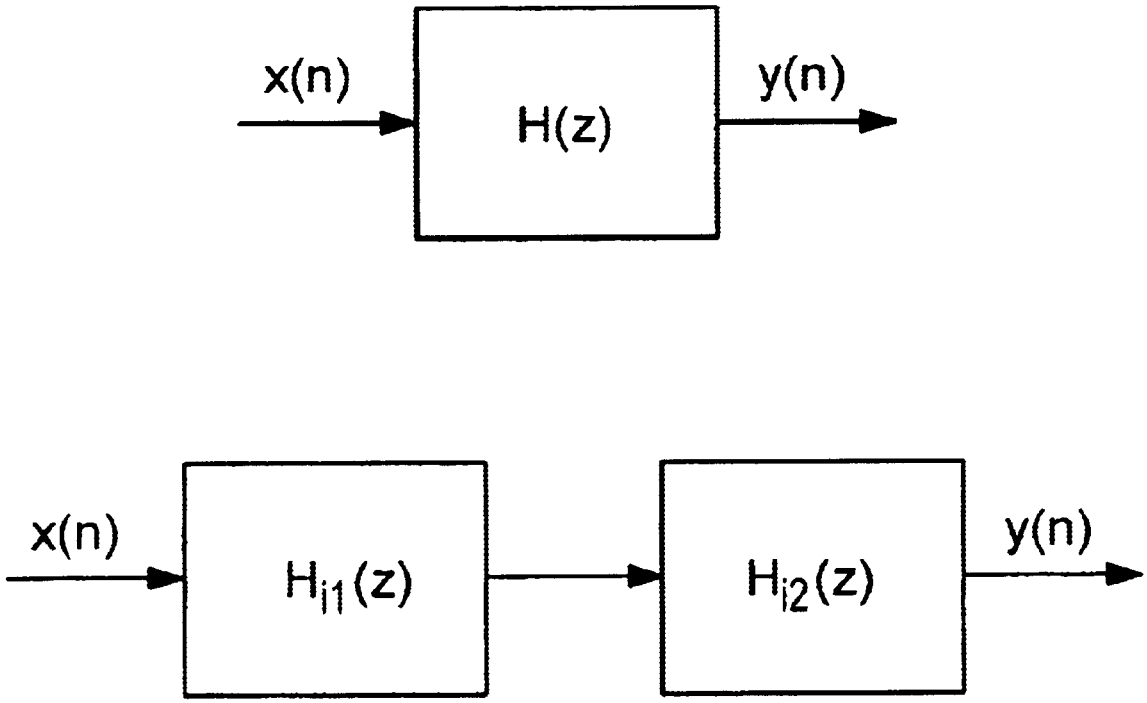
FIG. 12 is a block diagram illustrating that an AR model transfer function may be separated into two transfer functions.

The AR model has a transfer function of the form $$H_i(z) = \frac{1}{1 - \sum_{k=1}^{p} a_{ik} z^{-k}} \tag{9}$$

which can be reformulated as $$\begin{aligned} H_i(z) &= \frac{1}{\left(1 - \sum_{k=1}^{p-2} a_{ik}^1 z^{-k}\right)} - \frac{1}{1 + a_{i(p-1)}^1 z^{-1} + a_{i(}^1 z^{-2})} \\ &= H_{i1}(z) \cdot H_{i2}(z) \end{aligned} \tag{10}$$

where $a_{ik}^1$ represents the two new AR model coefficients. As illustrated in FIG. 12, one filter can be divided into two filters. $H_{i1}(z)$ represents the AR model calculated from the current speech segment and $H_{i2}(z)$ represent the new synthetic formant filter.

In one method, the synthetic formant(s) are represented by a complex conjugate pole pair. The transfer function $H_{i2}(z)$ may then be defined by the following equation:

$$h_{i2}(z) = \frac{b_0}{1 - 2v\cos(\omega_5) + v^2} \tag{11}$$

where v is the radius and $\omega_5$ is the angle of the pole. The parameter $b_0$ may be used to set the basic level of amplification of the filter. The basic level of amplification may be set to 1 to avoid influencing the signal at low frequencies. This can be achieved by setting $b_o$ equal to the sum of the coefficients in $H_{i2}(z)$ denominator. A synthetic formant can be placed at a radius of 0.85 and an angle of 0.58π. Parameter $b_0$ will then be 2.1453. If this synthetic formant is added to the AR model estimated on the narrowband speech signal, then the resulting transfer function will not have a prominent synthetic formant peak. Instead, the transfer function will lift the frequencies in the range 2.0–3.4 kHz. The reason that the synthetic formant is not prominent is because of large magnitude level differences in the AR model, typically 60–80 dB. Enhancing the modified signal so that the formants reach an accurate magnitude level decreases the formant bandwidth and amplifies the upper frequencies in the lower band by a few dB. This is illustrated in FIG. 13, in which dashed line 1310 represents the coarse spectral structure before adding a synthetic formant. Solid line 1320 represents the spectral structure after adding a synthetic formant, which generates a small peak at approximately 4.6 kHz.

Figure 14:
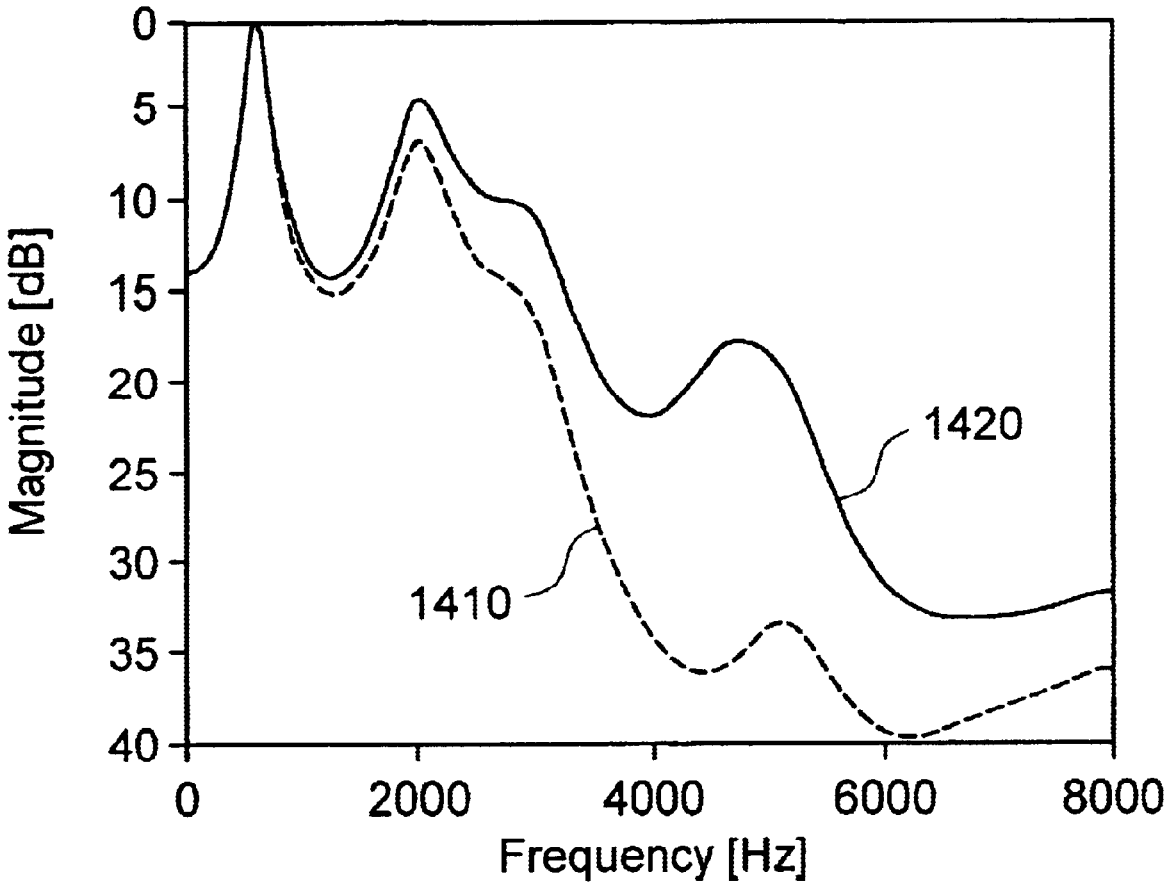
FIG. 14 is a graph illustrating the coarse structure of a speech signal before and after adding a synthetic formant to the speech signal.

Thus, a formant filter that uses one complex conjugate pole pair renders it difficult to make the formant filter behave like an ordinary formant. If high-pass filtered white noise is added to the speech signal prior to the calculation of the AR model parameters, then the AR model will model the noise and the speech signal. If the order of the AR model is kept unchanged (e.g., order eight), some of the formants may be estimated poorly. When the order of the AR model is increased so that it can model the noise in the upper band without interfering with the modeling of the lower band speech signal, a better AR model is achieved. This will make the synthetic formant appear more like an ordinary formant. This is illustrated in FIG. 14, in which dashed line 1410 represents the coarse spectral structure before adding a synthetic formant. Solid line 1420 represents the spectral structure after adding a synthetic formant, which generates a peak at approximately 4.6 kHz.

Figure 15:
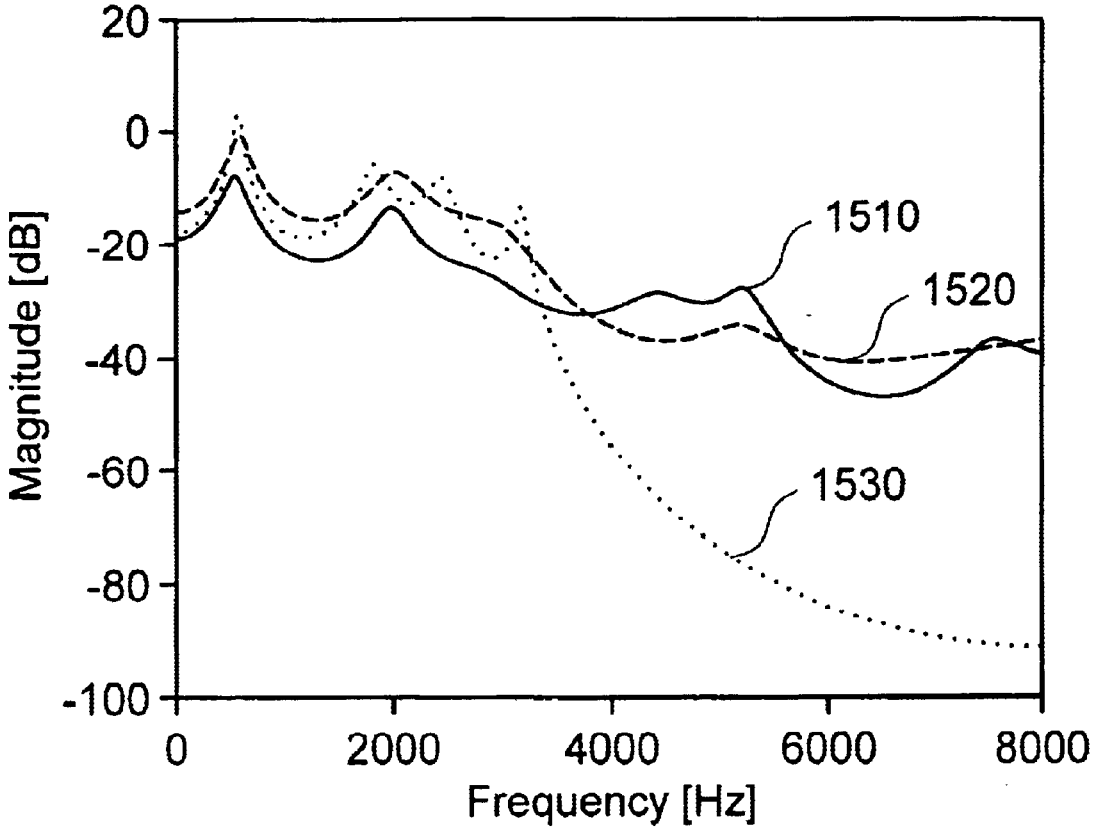
FIG. 15 is a graph illustrating the frequency response curves of AR models having different parameters on a speech signal.

FIG. 15 illustrates the difference between the AR model calculated with and without the added noise to the speech signal. Referring to FIG. 15, the solid line 1510 represents an AR model of the narrowband speech signal, determined to the fourteenth order. Dashed line 1520 represents an AR model of the narrowband speech signal, determined to the fourteenth order, and supplemented with high pass filtered noise. Dotted line 1530 represents an AR model of the narrowband speech signal determined to the eighth order.

Another way to solve the problem is to use a more complex formant filter. The filter can be constructed of several complex conjugate pole pairs and zeros. Using a more complicated synthetic formant filter increases the difficulty of controlling the radius of the poles in the filter and fulfilling other demands on the filter, such as obtaining unity gain at low frequencies.

To control the radius of the poles of the synthetic formant filter, the filter should be kept simple. A linear dependency between the existing lower frequency formants and the radius of the new synthetic formant may be assumed according to $$\nu_1\alpha_1+\nu_2\alpha_2+\nu_3\alpha_3+\nu_4\alpha_4=\nu_{\omega 5} \tag{12}$$

where $\nu_1$, $\nu_2$, $\nu_3$ and $\nu_4$ are the radius of the formants in the AR model from the narrowband speech signal. Parameters $\alpha_m$, m=1,2,3,4 are the linear coefficients. Parameter $\nu_{\omega 5}$ is the radius of the synthetic fifth formant of the AR model of the wideband speech signal. If several AR models are used then equation 12 can be expressed as $$\begin{bmatrix} r_{11} & r_{12} & r_{13} & r_{14} \\ r_{21} & r_{22} & r_{23} & r_{24} \\ \vdots & \vdots & \vdots & \vdots \\ r_{k1} & r_{k2} & r_{k3} & r_{k4} \end{bmatrix} \begin{bmatrix} \alpha_1 \\ \alpha_2 \\ \alpha_3 \\ \alpha_4 \end{bmatrix} = \begin{bmatrix} r_{15w} \\ r_{25w} \\ \vdots \\ r_{k5w} \end{bmatrix} \tag{13}$$

where ν are the formant radius and the first index denote the AR model number, the second index denotes formant number and the third index w in the rightmost vector denotes the estimated formant from the wideband speech signal, and k is the number of AR models. This system of equations is overdetermined and the least square solution may be calculated with the help of the pseudoinverse.

The solution obtained was then used to calculate the radius of the new synthetic formant as $$\hat{\nu}_{i5}=r_{i1}\alpha_1+r_{i2}\alpha_2+r_{i3}\alpha_3+r_{i4}\alpha_4 \tag{14}$$

where $\hat{\nu}_{i5}$, is the new synthetic formant radius and the α-parameters are the solution for the equation system 13.

The present invention is described above with reference to particular embodiments, and it will be readily apparent to those skilled in the art that it is possible to embody the invention in forms other than those described above. The particular embodiments described above are merely illustrative and should not be considered restrictive in any way. The scope of the invention is determined given by the following claims, and all variations and equivalents that fall within the range of the claims are intended to be embraced therein.

What is claimed is:

1. A method for processing a speech signal, comprising the steps of:

analyzing a received, narrowband signal to determine synthetic upper band content;

reproducing a lower band of the speech signal using the received, narrowband signal;

combining the reproduced lower band with the determined, synthetic upper band to produce a wideband speech signal having a synthesized component; and converting the wideband signal to an analog format.

2. The method of claim 1, further comprising the step of amplifying the wideband signal.

3. A method for processing a speech signal, comprising the steps of:

analyzing a received, narrowband signal to determine synthetic upper band content;

reproducing a lower band of the speech signal using the received, narrowband signal; and combining the reproduced lower band with the determined, synthetic upper band to produce a wideband speech signal having a synthesized component, wherein the step of analyzing further comprises the steps of:

performing a spectral analysis on the received narrowband signal to determine parameters associated with a speech model and a residual error signal;

determining a pitch associated with the residual error signal;

identifying peaks associated with the received, narrowband signal; and copying information from the received, narrowband signal into an upper frequency band based on at least one of the determined pitch and the identified peaks to provide the synthetic upper band content.

4. The method of claim 3, wherein the step of performing a spectral analysis employs an AR-predictor.

5. The method of claim 4, wherein the step of performing a spectral analysis employs a sinusoidal model.

6. The method of claim 3, further comprising the step of selectively boosting a predetermined frequency range of the wideband signal.

7. The method of claim 3, wherein the received, narrowband signal provides information content in the range of about 0–4 kHz and the synthetic upper band content is in the range of about 4–8 kHz.

8. A system for processing a speech signal, comprising:

means for analyzing a received, narrowband signal to determine synthetic upper band content;

means for reproducing a lower band of the speech signal using the received; narrowband signal; and means for combining the reproduced lower band with the determined, synthetic upper band to produce a wideband speech signal having a synthesized component, wherein the means for analyzing a received, narrowband signal to determine synthetic upper band content comprises:

a parametric spectral analysis module for analyzing the formant structure of the narrowband signal and generating parameters descriptive of the narrow band voice signal and an error signal;

a pitch decision module for determining the pitch of the sound segment represented by the narrowband signal; and a residual extender and copy module for processing information derived from the narrowband voice signal and generating a synthetic upper band signal component.

9. A system according to claim 8, wherein the residual extender and copy module comprises:

a fast fourier transform module for converting the error signal from the parametric spectral analysis module into the frequency domain;

a peak detector for identifying the harmonic frequencies of the error signal; and a copy module for copying the peaks identified by the peak detector into the upper frequency range.

10. A system according to claim 9, wherein the residual extender and copy module further comprises:

a module for generating artificial unvoiced speech content.

11. A system according to claim 10, wherein the residual extender and copy module further comprises:

a combiner for combining an output signal from the copy module and an output from the module fro generating artificial unvoiced speech content.

12. A system according to claim 11, wherein the residual extender and copy module further comprises:

a gain control module for weighting the input signals in the combiner.

13. A system according to claim 11, wherein the residual extender and copy module further comprises:

a fast fourier transform module for converting the error signal from the parametric spectral analysis module from the frequency domain into the time domain.

14. A system according to claim 8, wherein the means for reproducing a lower band of the speech signal using the received, narrowband signal comprises:

a parametric spectral analysis module for analyzing the formant structure of the narrowband signal and generating parameters descriptive of the narrowband voice signal and an error signal; and a synthesis filter.

15. A system for processing a narrowband speech signal at a receiver, comprising:

an upsampler that receives the narrowband speech signal and increases the sampling frequency to generate an output signal having an increased frequency spectrum;

a parametric spectral analysis module that receives the output signal from the upsampler and analyzes the output signal to generate parameters associated with a speech model and a residual error signal;

a pitch decision module that receives the residual error signal from the parametric spectral analysis module and generates a pitch signal that represents the pitch of the speech signal and an indicator signal that indicates whether the speech signal represents voiced speech or unvoiced speech;

a residual extender and copy module that receives and processes the residual error signal and the pitch signal to generate a synthetic upper band signal component.

16. A system according to claim 15, further comprising:

a synthesis filter that receives parameters from the parametric spectral analysis module and information derived from the residual error signal, and generates a wideband signal that corresponds to the narrowband speech signal.

17. A system according to claim 16, wherein the indicator signal from the pitch decision module controls a switch connected to an input to the synthesis filter, such that if the indicator signal indicates that the speech signal represents voiced speech, then the input to the synthesis filter is connected to the output of the residual extender and copy module, and if the indicator signal indicates that the speech signal represents unvoiced speech, then the input to the synthesis filter is connected to the residual error signal output from the parametric spectral analysis module.

* * * * *